US006446761B1

(12) United States Patent
Motoyama et al.

(10) Patent No.: US 6,446,761 B1
(45) Date of Patent: Sep. 10, 2002

(54) ELEVATOR SYSTEM HAVING WIRELESS TRANSMITTING/RECEIVING UNITS

(75) Inventors: Nobuhisa Motoyama, Tokai-mura; Hiromi Inaba, Hitachinaka; Atsushi Kawabata, Hitachi; Yoshinori Ohkura, Mito; Kenichi Yamashita, Hitachinaka, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/721,678

(22) Filed: Nov. 27, 2000

(30) Foreign Application Priority Data

Nov. 26, 1999 (JP) ..... 11-335466

(51) Int. Cl.[7] ..... B66B 1/34
(52) U.S. Cl. ..... 187/391; 187/247; 187/413
(58) Field of Search ..... 187/391, 393, 187/396, 380, 289, 297, 413, 414, 247

(56) References Cited

U.S. PATENT DOCUMENTS

| | | | | | |
|---|---|---|---|---|---|
| 4,594,570 | A | * | 6/1986 | Tweed, Jr. et al. | 340/121 |
| 4,709,788 | A | * | 12/1987 | Harada | 187/124 |
| 4,742,893 | A | * | 5/1988 | Otala et al. | 187/121 |
| 5,218,356 | A | * | 6/1993 | Knapp | 342/350 |
| 5,603,080 | A | * | 2/1997 | Kallander et al. | 455/14 |
| 5,736,692 | A | * | 4/1998 | Lumme et al. | 187/247 |
| 5,832,365 | A | * | 11/1998 | Chen et al. | 455/15 |
| 6,173,816 | B1 | * | 1/2001 | Barker et al. | 187/382 |

FOREIGN PATENT DOCUMENTS

| | | | |
|---|---|---|---|
| JP | 4-46979 | * | 3/1991 |
| JP | 5-292577 | * | 5/1993 |
| JP | 6-227766 | * | 6/1994 |
| JP | 6-348999 | * | 6/1994 |
| JP | 7-97152 | * | 7/1995 |
| JP | 7 206299 A | | 8/1995 |
| JP | 7 291553 A | | 11/1995 |
| JP | 9-66129 | * | 9/1997 |
| JP | 9-205908 | * | 9/1997 |
| JP | 10182023 | | 7/1998 |
| JP | 11-150505 | * | 11/1999 |

* cited by examiner

*Primary Examiner*—Jonathan Salata
(74) *Attorney, Agent, or Firm*—Antonelli, Terry, Stout & Kraus, LLP

(57) ABSTRACT

In order to make it possible to transmit and receive information between terminals and to reduce the number of wires used for an elevator in a building in an elevator system by transmitting and receiving information through wireless transmission even if a very weak radio wave having a narrow communicable range is used, an elevator control unit, a car terminal and floor terminals are individually provided with short distance wireless transmitting/receiving units having a communicable range of nearly a 2-floor distance (5 to 6 m) using very weak radio waves. The radio waves are received and transmitted between the wireless transmitting/receiving units located within the communicable range to transmit information by a relaying method of sequentially transferring information from terminal to terminal until it reaches a final destination.

16 Claims, 10 Drawing Sheets

ELEVATOR SYSTEM HAVING WIRELESS TRANSMITTING/RECEIVING UNITS

BACKGROUND OF THE INVENTION

The present invention relates to an elevator system in which information is transmitted and received by wireless transmission between an elevator control unit and terminals in an elevator car and on each of the floors serviced by the elevator system.

An elevator is operated in response to requests generated through operation of a hall call button placed at a landing entrance on each of the floors and a car call button (also called a destination button) located inside the elevator car, and the statuses of the hall call button on each of the floors and the car call button in the car are sequentially transmitted to an elevator control unit. Wire communication has been generally used for this type of transmission.

Use of a wireless system for information transmission between an elevator machine room and a car is proposed in Japanese Patent Application Laid-Open No. 6-227766, Japanese Patent Application Laid-Open No. 7-97152 and Japanese Patent Application Laid-Open No. 11-150505. Further, Japanese Patent Application Laid-Open No. 3-46979 discloses a system in which a control panel in an elevator machine room on a rooftop of a building and an indicator at a landing entrance on each floor are connected by a wireless communication line.

On the other hand, in technical fields other than those related to an elevator system, there is a technology that involves the use of a plurality of specified small power wireless transmitting/receiving units or very-weak radio wave transmitting/receiving units, by which information is transmitted not directly, but by relaying the information between the units. Such technologies are disclosed in Japanese Patent Application Laid-Open No. 5-292577, Japanese Patent Application Laid-Open No. 6-348999, Japanese Patent Application Laid-Open No. 9-66129 and Japanese Patent Application Laid-Open No. 9-205908.

The above-mentioned conventional technologies in the field of elevator system have not been widely used because it has been presumed that a wireless unit having a large output capacity needs to be used corresponding to the height of the building. Further, none of the known technologies is sufficient to reduce the number of elevator wires in the building serviced by the elevator system.

SUMMARY OF THE INVENTION

An object of the present invention is to provide an elevator system in which information can with certainty be transmitted between an elevator control unit and a car, a counterweight or a landing entrance on each floor, even if wireless transmitting/receiving units having a comparatively narrow communicable range are employed.

In a preferred embodiment of the present invention, wireless units for transmitting/receiving very weak radio waves are individually incorporated in an elevator control unit and a car terminal or floor terminals. The wireless transmitting unit on the terminal on the sending side transmits a very weak radio wave toward a final receiving side (final destination), including transmission information. One of the terminals located near the terminal on the sending side, which receives the radio wave, transmits a radio wave including the same information toward another of the terminals located within a communicable range. After that, the above-described process is repeated until the information is received at the final destination. In communicating with the terminal in the car, the terminals to be used as relay stations are selected based on car positional information at the present time to perform the relay transmission.

By the use of wireless transmission in which information is relayed using a terminal within a communicable range, it is possible to communicate between a sending side and a receiving side which are too far apart to directly communicate from one to the other, and in this way, it is possible to carry out the sending and receiving of information in an elevator system using wireless transmitting/receiving units having a relatively narrow communication range.

DETAILED DESCRIPTION OF THE PREFERRED EMBODIMENT

Figure 1:
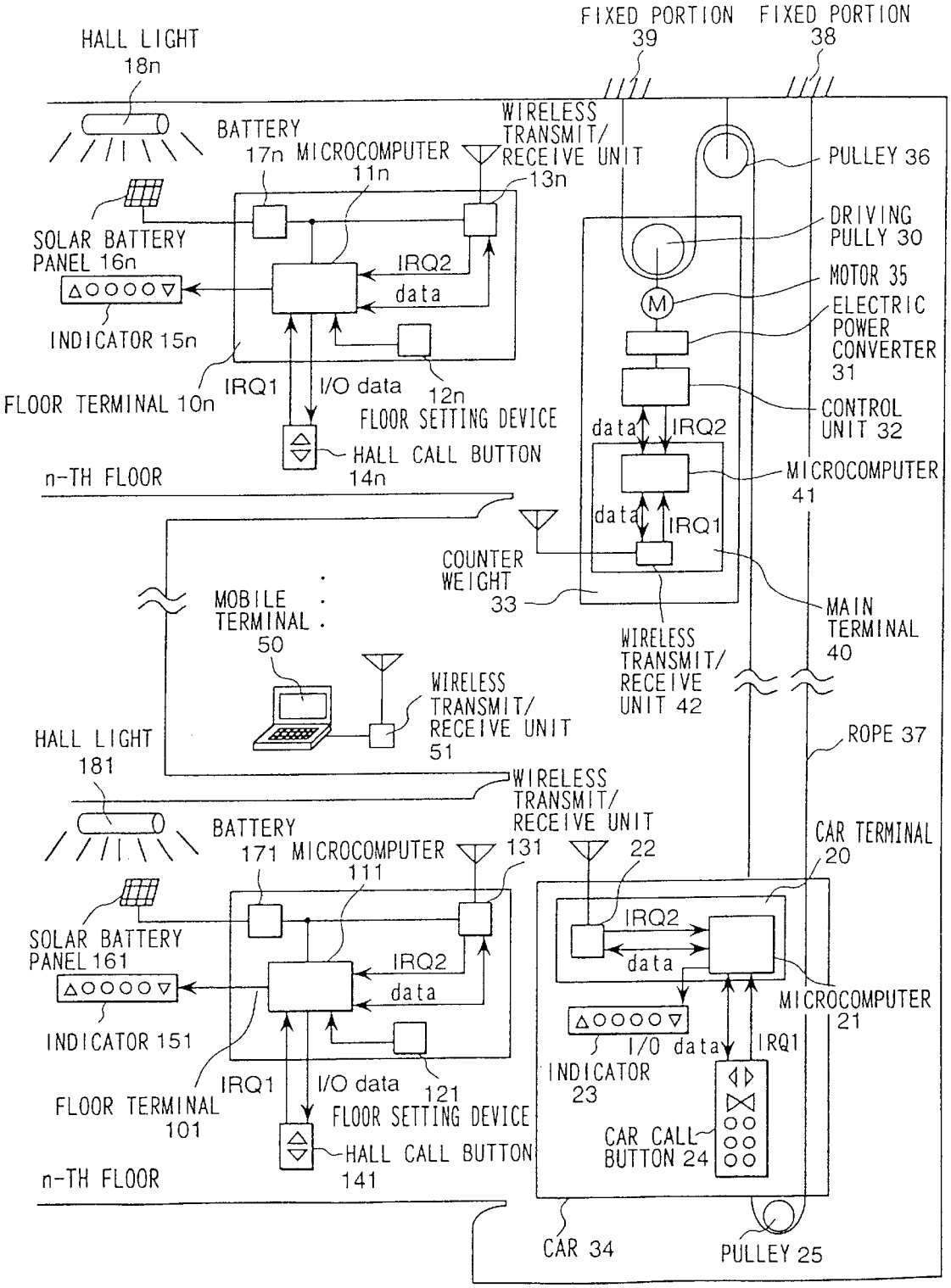
FIG. 1 is a block diagram showing the construction of an embodiment of an elevator system in accordance with the present invention.

FIG. 1 is a block diagram showing the construction of an embodiment of an elevator system in accordance with the present invention. A rope 37 is wound around a pulley 36 suspended from a ceiling of an elevator hoistway, and an elevator car 34 and a counterweight 33 are suspended on the rope on either side of the pulley 36 so as to counter each other in weight. That is, one end of the rope 26 is fixed to a portion 38 in the ceiling, and the rope goes downward from there and passes though a pulley 25 mounted on the lower side of the car 34, turns upward, and then is wound around the pulley 36. Further, the rope 37 goes downward from the pulley 36 and passes through a drive pulley 30, from which the counterweight 33 is suspended, and is turned upward from the pulley 30, with the other end thereof being fixed to a position 39 in the ceiling.

The elevator is driven by a rotation force of a motor 35, which is mounted on the counterweight 33. That is, an electric power converter 31 is controlled by a control unit 32 to supply a variable-voltage, variable-frequency alternating current as electric power to the motor 35. The motor 35 drives the driving pulley 30, corresponding the alternating current electric power, and drives the counterweight 33 and the elevator car 34 through the rope wound around the sheave.

Operation of the elevator is controlled by an elevator control unit 32. The elevator control unit 32 is mounted on the counterweight 33 and controls the operation of the elevator in response to service requests initiated by actuation of hall call buttons 141 to 14*n* arranged on the floors and car call buttons 24 arranged in the car 34. Call information of the hall call buttons 141 to 14*n* and a car call button 24 is transmitted by wireless (radio wave) transmission through wireless transmit/receive terminals 131 to 13*n* and 22. The transmitted call information is received by a main terminal 40, which also has a wireless transmit/receive terminal 42, and the received call information is transferred to the control unit 32. The wireless transmitting/receiving unit used here is the type of wireless transmitting/receiving unit which is usable without any license or any permit. Such a wireless transmitting/receiving unit is, for example, a short distance wireless transmitting/receiving unit having a communicable range of 2.5 to 10 m, that is, using a very weak radio wave defined by the radio wave law, that is, ① a radio wave in a frequency band which is less than 322 MHz and having an electric field intensity at a 3 m distant position which is less than 500 $\mu$V/m, ② a radio wave in a frequency band which is within the range of 322 MHz to 10 GHz and having an electric field intensity at a 3 m distant position which is less than 35 $\mu$V/m, ③ a radio wave in a frequency band which is within the range of 10 GHz to 150 GHz and having less than 3.5 (f$\mu$V/m) within a range of an electric field intensity at a 3 m distant position not exceeding 500 $\mu$V/m, and ④ a radio wave in a frequency band which is within a range above 150 GHz and having an electric field intensity at a 3 m distant position which is less than 500 $\mu$V/m.

Figure 2:
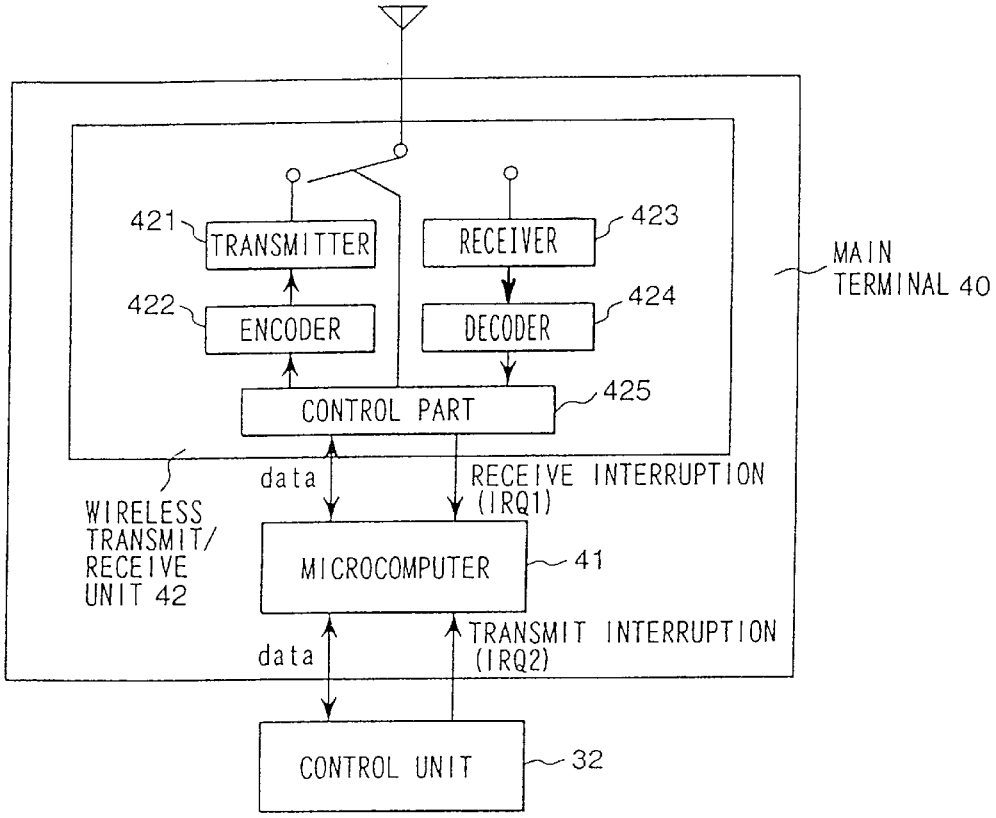
FIG. 2 is a block diagram showing the construction of a main terminal.

FIG. 2 is a block diagram showing the construction of the wireless transmitting/receiving unit 42. Although the construction of each of the wireless transmitting/receiving units 131 to 13*n* and 22 of the terminals is the same as that of the wireless transmitting/receiving unit 42, only the main terminal 40 mounted on the counterweight 33 will be described as a typical example. The wireless transmitting/receiving unit 42 comprises both a transmitter 421 and a receiver 423, and transmitted data and received data are converted between serial/parallel data by an encoder 422 and a decoder 424, respectively, to communicate with a microcomputer 41. Switching between transmitting and receiving is performed by a control part 425, and the wireless transmitting/receiving unit 42 is normally in the receiving state and is switched to the transmitting state only when a transmitting request (transmit interruption: IRQ2) is received from the control unit 32. The microcomputer 41 accepts an interruption signal (IRQ1) indicating receipt of a radio wave in addition to transmit/receive data from the wireless unit 42. The microcomputer 41 is triggered by receipt of the interruption signal (IRQ1) to perform appropriate processing (different from terminal to terminal processing) to be described later.

The main terminal 40 has control information which it uses in common with the control unit 32, and transmits and receives by wireless transmission the following three kinds of information to and from the floor terminals 101 to 10*n* and the car terminal 20 through the wireless unit 42 mounted on the main terminal 40.

A first kind of information is call information indicating a state of the hall call buttons 141 to 14*n* and the car call button 24 (which button is pushed), and a second kind of information is information commanding the turning-on of a lamp of each of the hall call buttons 141 to 14*n* or the car call button 24. A third kind of information is car position information displayed on indicators 151 to 15*n* and 23 individually arranged at the floors and in the car for indicating a car position. The call information is information transmitted to the main terminal from the floor terminals 101 to 10*n* and the car terminal 20, and the other kinds of information include information transmitted from the main terminal 40 to the floor terminals 101 to 10*n* and the car terminal 20. These kinds of information are transmitted by relay transmission in a manner to be described later.

The construction of a floor terminal will be described below, taking the floor terminal 101 on the first floor, as shown in FIG. 1, as a typical example. The construction of the floor terminals 102 to 10*n* installed on the other floors is the same as that of the floor terminal 101 on the first floor.

The floor terminal 101 comprises a microcomputer 111, a wireless transmitting/receiving unit 131, a floor setting device 121 and a battery 171. Further, the floor terminal 101 is constructed so as to connect to a hall call button 141 and an indicator 151 and a solar battery panel 161. The microcomputer 111 can detect a state of the hall call button 141 through an I/O port and can turn on the lamps of the hall call button 141 and the indicator 151. Therefore, when the hall call button 141 is pushed, the floor terminal 101 transmits this status information to the main terminal 40 through the wireless transmitting/receiving unit 131. The floor terminal 101 receives the lamp turning-on command information or the car position information transmitted from the main terminal 40, and turns on the lamp of the hall call button 141 or the indicator 151 according to the received information.

The floor setting device 121 is provided for setting a floor setting in the floor terminal 101 (a floor value) and is composed of a dual inline package (DIP) switch and so on. A set floor value is input to the microcomputer 111 and is used when a destination (a final destination or a transfer destination) indicated by a received radio wave is to be determined.

Light energy of hall light 181 is converted to electric energy using the solar battery panel 161 mounted at floor terminal 101, and the electric energy is used as a drive electric power source of the floor terminal 101. The battery 171 is used for storing electric power. By doing so, the electric power cable can be eliminated, and, accordingly, the work involved in installation of the floor terminals can be reduced together with elimination of the information transmission cables.

It may be possible to supply electric power to the battery 171 from an energy storing unit installed in the car 34 or the counterweight 33 when the car 34 and the counterweight 33 are stopped, which electric power can be used as the driving electric power source of the floor terminal 101, thereby eliminating the need for the solar battery panel 161. In this case, since the solar battery panel 161 is unnecessary, there is an advantage in that it is possible to avoid the appearance of the hall from being spoiled. Although the energy supply to the energy storing unit mounted on the car 34 or the counterweight 33 is not particularly specified in the drawing, it is assumed that the energy storing unit is supplied with electric power from a contact or non-contact power supply unit installed on an appropriate floor.

Next, the car terminal 20 will be described. The car terminal 20 also comprises a microcomputer 21 and a wireless transmitting/receiving unit 22, and an indicator 23 and the car call button 24 are connected to the car terminal 20. The car terminal 20 detects information concerning the status of the car call button 24, and it transmits a radio wave to the main terminal 40 through the wireless transmitting/receiving unit 22. The car terminal 20 also receives lamp turning-on command information or car position information transmitted from the main terminal 40, and it will turn on the lamp of the car call button 24 or the indicator 23 in response to such command information.

In addition to the three kinds of terminals described above, a mobile terminal 50 connected to a wireless transmitting/receiving unit 51 is included in the information transmission network composed of the terminals and operates as an additional terminal. In detail, the mobile terminal is formed by a personal computer or the like. Using the mobile terminal 50, it is possible to access the control unit 32 through each terminal, as well as the main terminal 40 similarly to each other terminal, and to operate with control information and general information (service information) in common with the control unit 32. By doing so, a person in charge of maintenance can perform maintenance work without going to the machine room. In the case where the mobile terminal 50 is included in the information transmission network as one terminal, it is preferable that an identification code be given to the mobile terminal 50 and the main terminal 40 in advance, so that the mobile terminal is permitted to be integrated into the information transmission network only when the proper identification code is included in the transmission. A position where the mobile terminal 50 exists (on a floor or in the car) is input to the mobile terminal 50 as a position code in order to specify the position of the mobile terminal 50, and this information is transmitted and sent together with the identification code to the main terminal 40 (the control unit 32). The transmission of a radio wave to the mobile terminal 50 is sent to a terminal (the floor terminal or the car terminal) which is designated as the mobile terminal.

The relay transmission of radio signals using wireless communication (short distance wireless) will be described below.

The relay transmission of information makes it possible to communicate between wireless stations (sending side and receiving side) using the short distance wireless transmission even if the distance between the originating and destination wireless stations is beyond the communicable range. That is, by relaying information through the other wireless stations within the communicable range from the sending side, it makes it possible to communicate with a wireless station outside the communicable range. The present embodiment employs a short distance wireless transmission having a communicable range of nearly a 2-floor distance (for example, from the first floor to the third floor). By employing such a relay transmission method, short distance wireless transmitting/receiving units of small capacity can be used even if the communicable range is as narrow as a 2-floor range.

Figure 3:
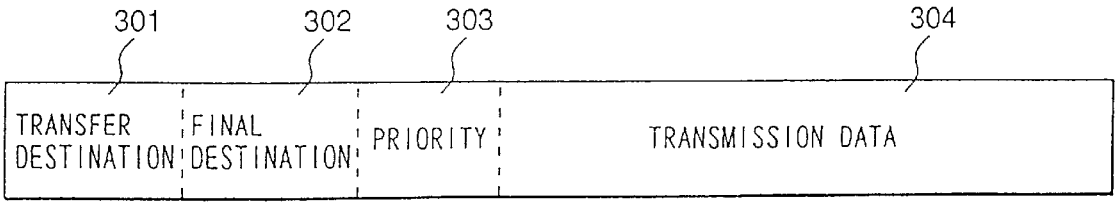
FIG. 3 is a diagram showing the data construction of transmission information.

FIG. 3 shows the data construction of a transmitting/receiving signal. In order to efficiently perform a relay transmission, a radio wave is sent in a form which includes not only an indication of the final destination 302 representing the final receiving side station, but also a transfer destination 301 representing a relay station, in addition to the data 304 to be transmitted. In the terminal assigned as the relay station, the transfer destination 301 is changed to a designation of a terminal to serve as the next relay station. The priority 303 is an additional item of information used to specify a priority of the data to be transmitted, and is set as a priority (high/low level) for each item of information to be transmitted. That is, ① the priority of call information from the floor terminals and the car terminal to the main terminal is set to the high level, and ② the priority of the car position information and the lamp turning-on command information from the main terminal to the floor terminals and the car terminal is set to the low level. By switching of the relay transmission path to be described below using the priority 303, information to be hurried is given priority in transmission to make the transmission speedy. The priority levels may be classified into three or more levels. At the transfer destination, information may be added to the transmitted data 304 provided by the initial sending station if the transfer destination has any information to be transmitted to the same final destination.

Figure 4:
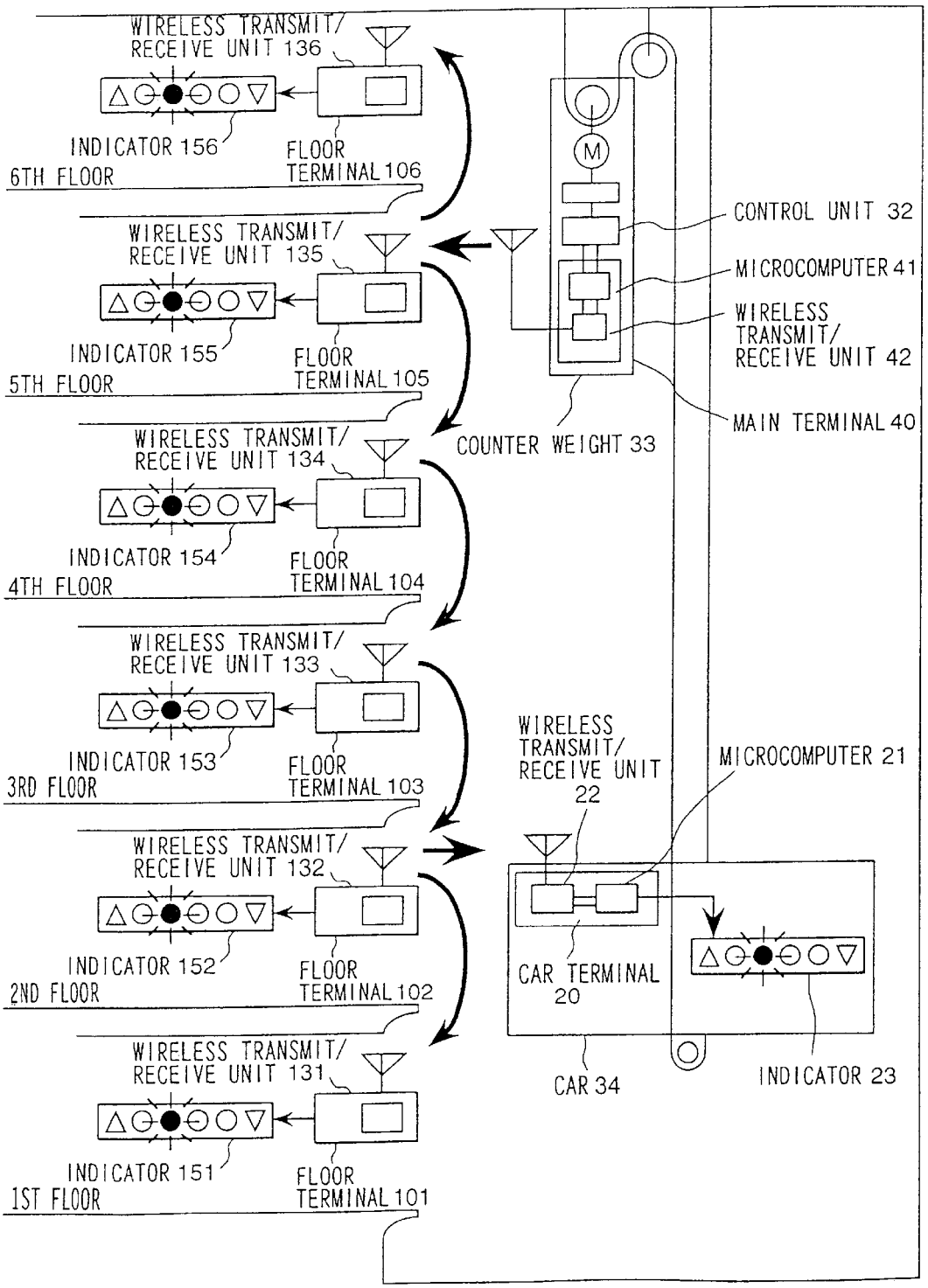
FIG. 4 is a block diagram showing a transmission path of information having a low priority.

FIG. 4 shows a transmission path (a low speed transmission path) of information having the low priority, and the relay station (transfer destination) is assumed to be a floor terminal on the adjacent floor. The communicable range of an wireless transmitting/receiving units is larger than 2.5 m which is the minimum floor pitch of the building, such as an apartment house. FIG. 4 shows an example of transmission of car position information. The control unit 32 having the car position information supplies information to the car terminal 20 and all the floor terminals 101 to 106 through the wireless transmitting/receiving unit 42. The main terminal 40 transmits a radio wave, in which the car position information is provided as the transmitted data, by setting the car terminal 20 and the floor terminals on the uppermost floor and the lowermost floor (on the sixth floor and on the first floor in the FIG.) as the final destinations, and by further setting the floor terminal (the floor terminal 105 on the fifth floor in the FIG.) adjacent to the position of the counterweight 33 (the main terminal 40) as the transfer destination. The floor terminal 105 on the fifth floor, upon receiving the radio wave sets the floor terminals 106, 104 on the sixth floor and on the fourth floor as the transfer destinations determined from the final destinations and transmits a radio wave to the floor terminals 106, 104. After that, the information is transferred stages by setting the adjacent floor terminals to the transfer destination at each stage. The floor terminal 102 on the second floor, when it receives the information, transfers the information to the floor terminal 101 on the first floor, and, at the same time, it also transfers the information to the car terminal 20.

As described above, when the final destination for a communication is the car terminal 20 or the main terminal 40, the floor terminal determines the position of the car 34 or of the counterweight 33 from the car position information so as to select a transfer destination adjacent to these mobile objects.

Figure 5:
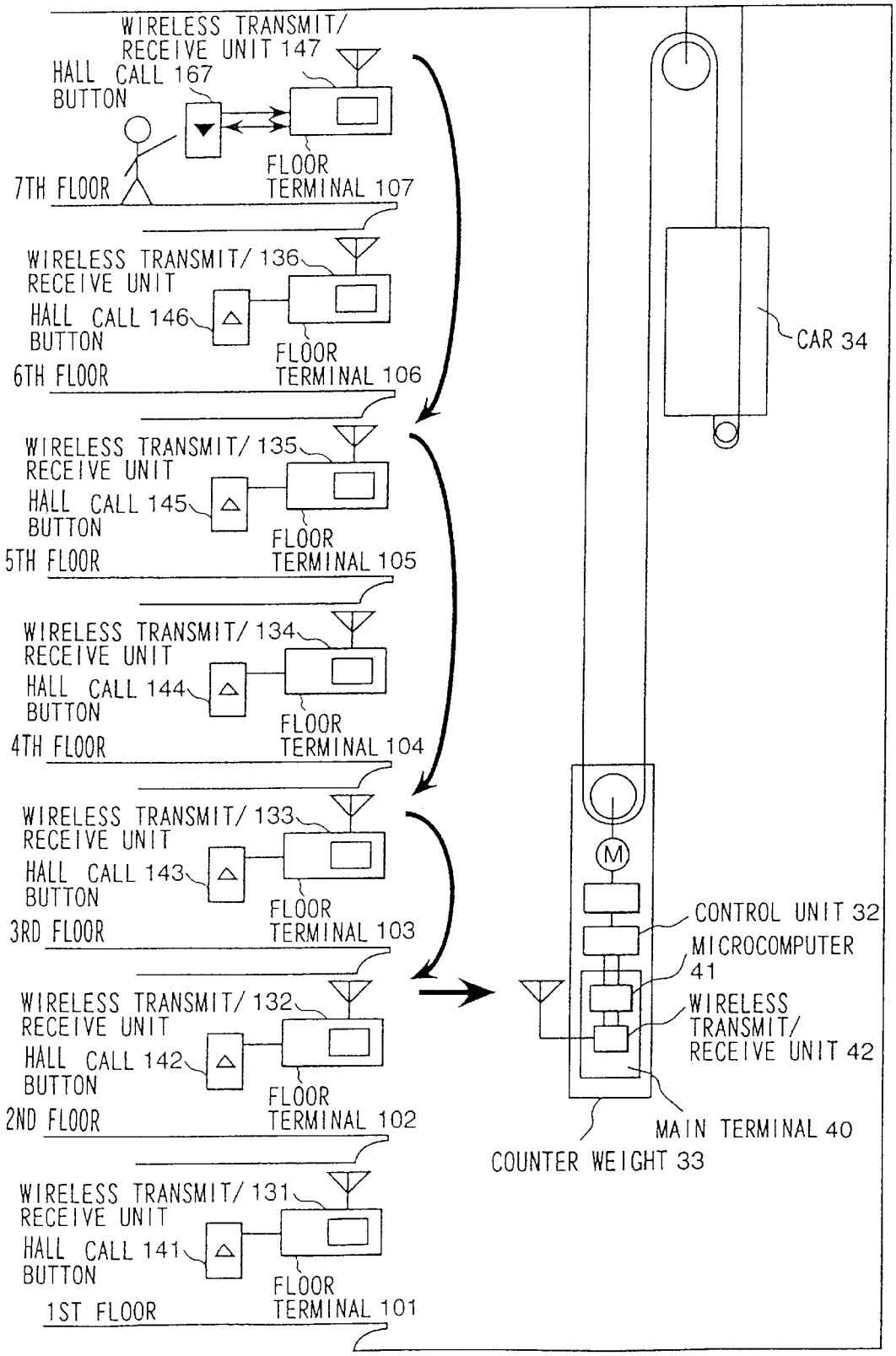
FIG. 5 is a block diagram showing a transmission path of information having a high priority.

FIG. 5 shows a high speed transmission path for information having a high priority. In the case of a high level priority communication, a terminal on a not-adjacent floor (one floor is skipped in the present embodiment) is set to be the relay station. The only difference is in the setting of the transfer destination, and the transfer itself is the same as carried out in the low speed transmission path. FIG. 5 shows an example of the transmission of information from a hall call button (the priority: high level) in which the final destination is the main terminal 40, and the first relay station selected is the 5th floor terminal 135 by skipping the 6th floor. Since the transfer destination is always set in accordance with the positions of the car terminal 34 and the counterweight 33 similarly to the above, in the floor terminal 103 on the third floor, the transfer destination is set not to the floor terminal 101 on the first floor, but is set to the floor terminal 102 on the second floor, and the information is transferred from the floor terminal 102 on the second floor to the car terminal 20.

When the sending side and the receiving side exist within the direct communicable range, the radio wave communication is performed between the sending side and the receiving side not though any relay station. For example, in a case where the car terminal 20 and the main terminal 40 are close to each other, or in a case where a floor terminal and the main terminal are close to each other, radio wave exchange is performed directly between these terminals which are close to each other.

Figure 6:
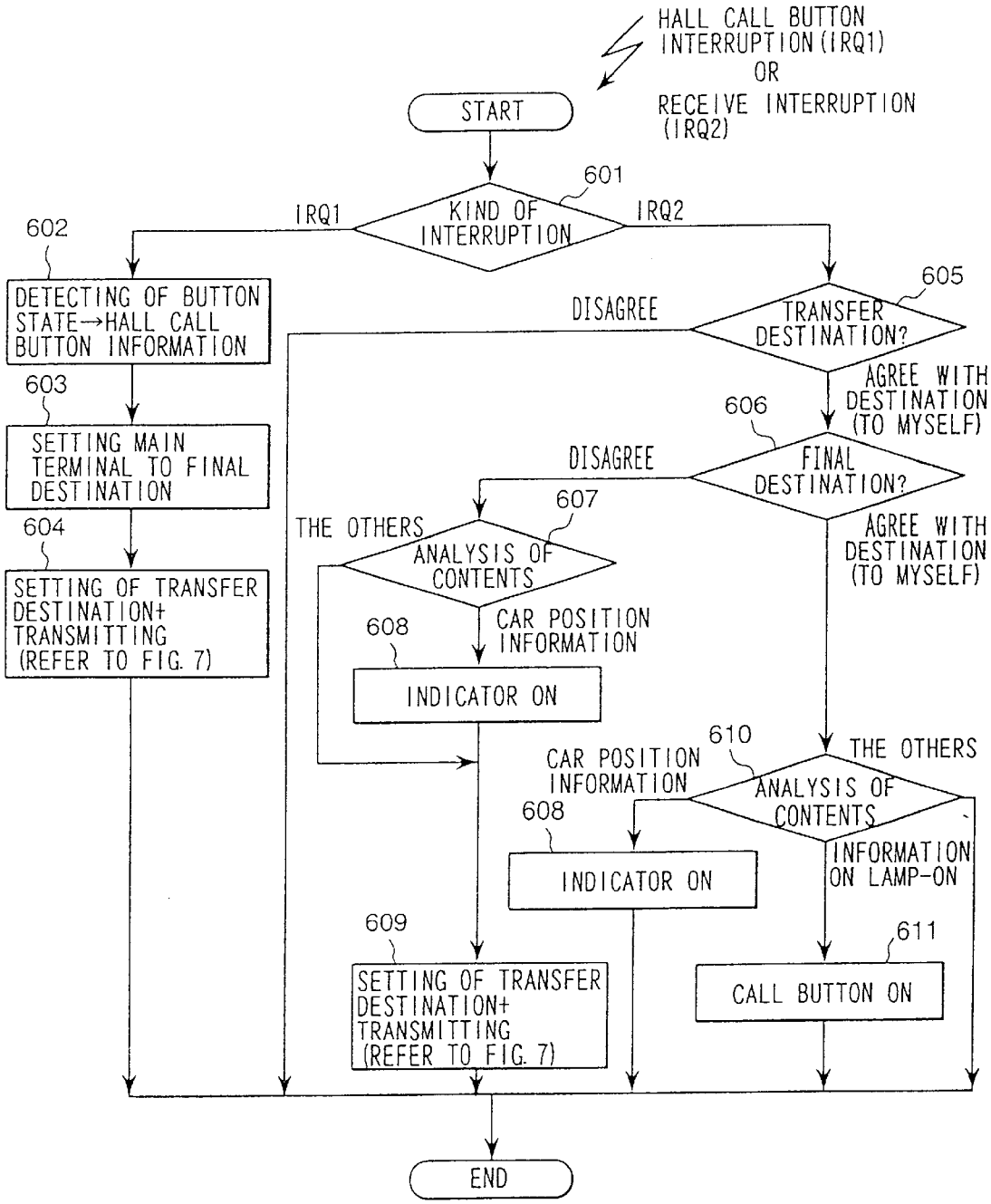
FIG. 6 is a flowchart showing the processing in a floor terminal.

FIG. 6 shows the processing performed by the microcomputer in the floor terminal, and the processing is common in the floor terminals on all the floors. A description of this processing will be provided, taking the floor terminal 101 on the first floor as a typical example. Two kinds of interruption signals are input to the microcomputer 111 in the floor terminal 101 from the hall call button 141 and the wireless transmitting/receiving unit 131. One is an interruption signal (IRQ1) generated by pushing the hall call button 141, and the other is an interruption signal (IRQ2) generated when the wireless transmitting/receiving unit 131 receives a radio wave. The microcomputer 111 executes the following processing in response to the two interruption signals.

Initially, in Step 601, the kind of the input interruption signal is judged. If the judged result is that the input interruption signal is the hall call button interruption signal (IRQ1), the processing proceeds to Step 602. If the judged result is that the input interruption signal is the signal receive interruption signal (IRQ2), the processing proceeds to Step 605.

First, the case of the hall call button interruption signal (IRQ1) will be described. In Step 602, it is detected which button among the hall call buttons 141 is pushed. This information directly becomes transmission data having the high level priority (hall call button information). Then, in Steps 603, 604, a final destination and a transfer destination are set. The final destination is the main terminal 40, but the transfer destination is determined in transfer destination setting processing to be described later because it is necessary to take the position of the main terminal 40 into consideration. After completion of setting of the final destination and the transfer destination, the processing is completed by sending a radio wave from the wireless transmitting/receiving unit 131.

The case of the signal receive interruption signal (IRQ2) will be described next. In Steps 605 and 606, the destinations (the final destination, the transfer destination) of the received radio wave is checked. The checking of the destinations is performed by comparing a floor value set in the floor setting device 121 with the destinations indicated in the transmission data to judge whether or not the destinations agree with the floor value. In Step 605, it is judged whether or not transfer of the received information is necessary (transfer of the received information is necessary when the transfer destination accords with the floor value). For example, if the transfer destination does not accord with the floor value, it is judged that the received radio wave has no relation to that floor, and the processing is completed. On the other hand, if the transfer destination agrees with the floor value, the processing proceeds to Step 606, in which it is judged whether or not the final destination agrees with the floor value. If the final destination does not agrees with the floor value, transfer processing of the received radio wave is performed in Step 607 and the following steps. In Step 607, it is judged whether or not the received radio wave includes car position information. If the received radio wave includes car position information, the lamp of the indicator 151 is turned on through an I/O port of the microcomputer 111 using the information under transferring (Step 608). Then, transfer processing of the received radio wave is performed in Step 609. In the transfer processing in Step 609, since the transfer destination needs to be determined depending on the final destination and the priority of the transferred information, the transfer destination is determined in transfer destination setting processing (to be described later), and then the radio wave is transmitted from the wireless transmitting/receiving unit 131.

If the final destination agrees with the floor value in Step 606, the processing proceeds to Step 610 to analyze the contents of the transferred information and execute the corresponding processing. If the transferred information is lamp turning-on information, the lamp of the hall call button 141 is turned on in Step 611. If the transferred information is car position information, the lamp of the indicator 151 is turned on in Step 612. If it is judged in the processed contents of Step 610 that the information is other than the above-mentioned kinds of information, it is judged that the transmitted radio wave is information to the mobile terminal 50 described above and the floor terminal directly ends the processing.

In the case of communication from the main terminal 40 to the mobile terminal 50, since the radio wave is transmitted to a terminal (here, the floor terminal) of the set position code (a floor or the car where the mobile terminal 50 is specified), the floor terminal completes the processing neglecting the transmitted information.

Figure 7:
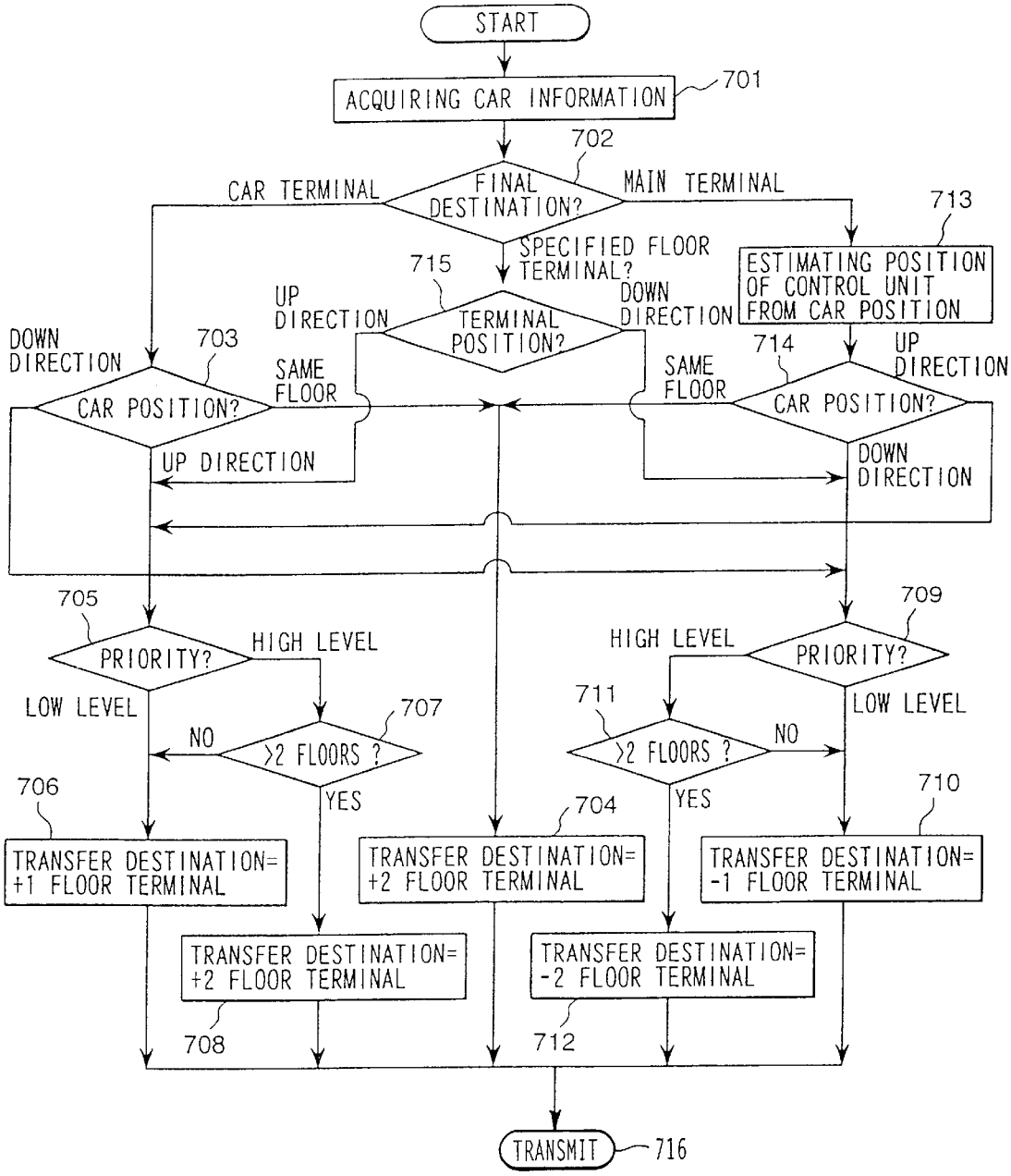
FIG. 7 is a flowchart showing the transfer destination determining processing of a relay transmission in each terminal.

FIG. 7 is a flowchart showing the transfer destination setting processing. Initially, the car position information is acquired in Step 701 in order to determine the position of the car terminal 20 (including the main terminal 40). In Step 702, the final destination is judged. If the final destination is the car terminal, the processing proceeds to Step 703. If the final destination is the main terminal, the processing proceeds to Step 713. If the final destination is a specified floor terminal, the processing proceeds to Step 715.

Initially, the case where the final destination is the car terminal will be described. In Step 703, it is judged (from the floor value set by the floor setting device 121) where the car 34 having the car terminal 20 is located with respect to the floor terminals (including the main terminal 40). Therein, the judged results are expressed as three possibilities, such as on an upper level/on the same floor level/on a lower level. For example, if the car terminal 20 is on the same level, the radio wave is sent to the car terminal 20 (Step 715) without setting any transfer destination (Step 704) because the car terminal 20 is at a distance which the radio wave can directly reach. If the car terminal 20 is on an upper floor level, the processing proceeds to Step 705 to check the priority of the information in order to determine a transfer destination. If the priority is low, the transfer destination is set to the floor terminal on the +1 floor (Step 706). On the other hand, if the priority is high, the transfer destination is set to the floor terminal on the +2 floor (Step 708). Then, the radio wave is transmitted in Step 716. Therein, the transfer destination may exceed the final destination when the transfer destination is set by the +2 floor. Therefore, a floor difference with respect to the final destination is checked in Step 707, and the floor terminal on the +2 floor is set only when the floor difference is above two floors. On the other hand, if the car terminal 20 is found in Step 703 to be on a lower floor level, the processing proceeds to Step 709 to similarly check the priority of the transmitted information. However, unlike the above, if the priority is low, the transfer destination is set to the floor terminal on the −1 floor in Step 710. If the priority is high, the transfer destination is set to the floor terminal on the −2 floor in Step 712. Then, the radio wave is transmitted (Step 716). In this case, the floor difference is similarly checked in Step 711 to determine an appropriate transfer destination.

Further, in Step 702, if the final destination is the main terminal, the position of the main terminal is estimated in Step 713. The main terminal 40 located in the counterweight 33 is moved upward and downward similarly to the car 34. Therefore, the position of the counterweight 33 (the main terminal 40) is estimated from the car position information to determine a terminal on an adjacent floor. In Step 714, it is judged where the position of the main terminal 40 is located with respect to the floor terminals (including the car terminal 20). The judged results are expressed as three possibilities, such as on an upper level/on the same floor level/on a lower level. The setting of the transfer destination after that is similar to the Steps 705 to 708 described above.

In Step 702, if the final destination is the floor terminal on a specified floor, the processing proceeds to Step 715 to judge (only in the vertical direction) where the floor terminal on the specified floor is located with respect to the floor terminals (including the car terminal 20). The setting of the transfer destination after that is similar to the processing described above. The floor terminal on a specified floor includes the mobile terminal 50.

Figure 8:
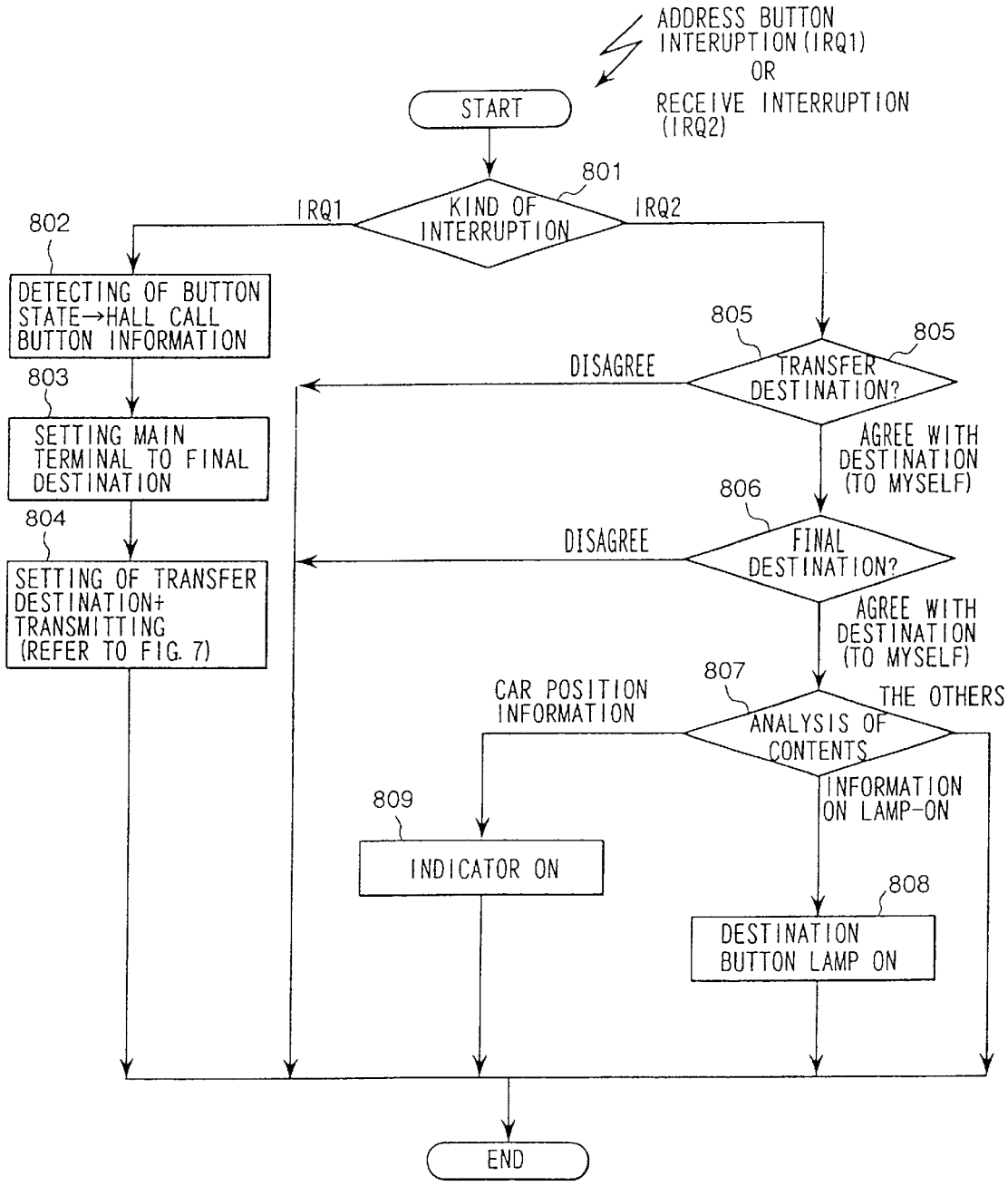
FIG. 8 is a flowchart showing the processing in a car terminal.

FIG. 8 is a flowchart showing the processing performed in the microcomputer 21 in the car terminal 20. Two kinds of interruption signals are input to the microcomputer 21 in the car terminal 20 from the car call button 24 and the wireless transmitting/receiving unit 22. One is an interruption signal (IRQ1) generated by pushing the car call button 24, and the other is an interruption signal (IRQ2) generated when the wireless transmitting/receiving unit 22 receives a radio wave. The microcomputer 21 executes the following processing in response to the two interruption signals.

In Step 801, the kind of the input interruption signal is judged. If the judged result is that the input interruption signal is the destination button interruption signal (IRQ1), the processing proceeds to Step 802. If the judged result is that the input interruption signal is the signal receive interruption signal (IRQ2), the processing proceeds to Step 805.

First, the case of the destination button interruption signal (IRQ1) will be described. In Step 802, it is detected which button among the car call buttons 24 is pushed. This information directly becomes transmission data having the high level priority (car call button information). Then, in Steps 803, 804, a final destination and a transfer destination are set. The final destination is the main terminal 40, and the transfer destination is determined in the above-mentioned transfer destination setting processing by taking the position of the main terminal 40 into consideration. After completion of setting of the final destination and the transfer destination, a radio wave is sent from the wireless transmitting/receiving unit 22.

The case of the signal receive interruption signal (IRQ2) will be described next. In Steps 805 and 806, the destinations (the final destination, the transfer destination) of the received radio wave is checked. In the present embodiment, the transfer processing in the relay transmission is not performed in the car terminal 20, which is different from the processing in the floor terminal described above. Therefore, if the destination does not agree with the car terminal identification, the processing is directly completed.

In this case, the judgment step of "TRANSFER DESTINATION?" in Step 805 appears to be unnecessary. However, supposing that the car terminal erroneously receives (picks up) a signal unnecessary to the receipt of a "radio wave in which the transfer destination is another terminal and the final destination is the car terminal itself", the judgment in Step 805 in the present embodiment has the role of excluding such a radio wave.

If the transfer destination and the final destination agree with the car terminal identification, the processing proceeds to Step 807 to analyze the contents of the transferred information and to execute the corresponding processing. If the transferred information is lamp turning-on information, the lamp of the car call button 24 is turned on in Step 808. If the transferred information is car position information, the lamp of the indicator 23 is turned on in Step 809. If it is judged in the processed contents of Step 807 that the information is other than the above-mentioned kinds of information, it is judged that the transmitted radio wave is information being transmitted to the mobile terminal 50 described above. In this case, the mobile terminal is in the car 34, and the radio wave is transmitted to the car terminal as the final destination. Therefore, the car terminal 20 directly ends the processing by neglecting the information.

Figure 9:
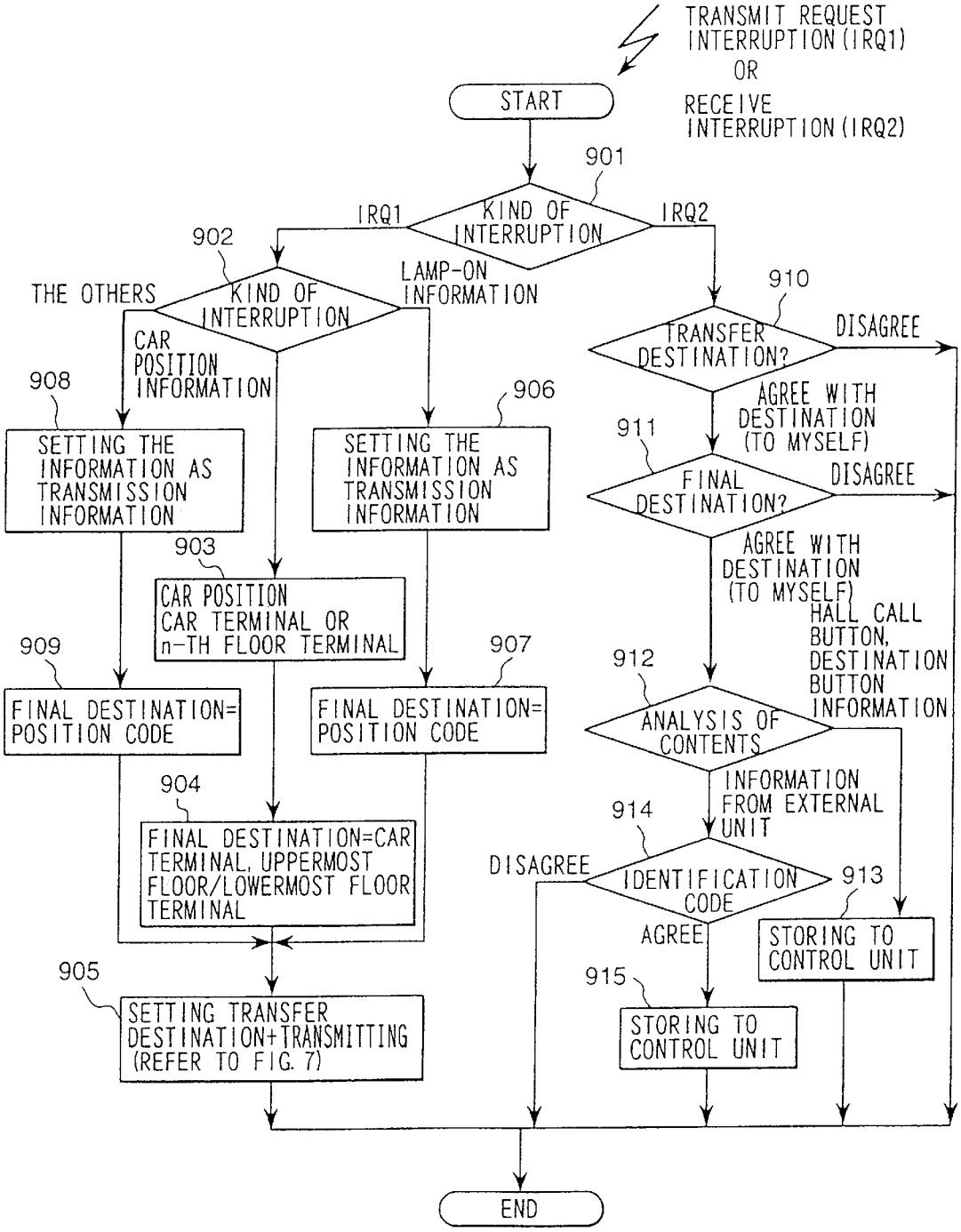
FIG. 9 is a flowchart showing the processing in a main terminal.

FIG. 9 is a flowchart showing the processing in the main terminal 40. Two kinds of interruption signals are input to the microcomputer 41 in the main terminal 40 from the control unit 32 and the wireless transmitting/receiving unit 42. One is an interruption signal (IRQ1) in regard to a request for transmitting a radio wave from the control unit 32, and the other is an interruption signal (IRQ2) generated when the wireless transmitting/receiving unit 42 receives a radio wave. The microcomputer 41 executes the following processing with the two interruption signals serving as the trigger.

In Step 901, the kind of the input interruption signal is judged. If the judged result is that the input interruption signal is the transmission request interruption signal (IRQ1), the processing proceeds to Step 902. If the judged result is that the input interruption signal is the signal receive interruption signal (IRQ2), the processing proceeds to Step 910. Initially, the case of the transmission request interruption (IRQ1) will be described. In Step 903, the contents of the transmitted signal are judged. If the transmitted information is car position information, the processing proceeds to Step 903. If the transmitted information is lamp turning-on information, the processing proceeds to Step 906. The case of the car position information will be described. The car position information is set to the transmitted data in Step 903, and then the final destination is set in Step 904. The car position information needs to be sent to the floor terminals on all the floors and the car terminal, and the final destinations are set to the car terminal 20 and the floor terminals on the uppermost floor and on the lowermost floor, and then transmitted to the three final destinations in Step 905. The transfer destinations for transmitting the car position information are determined through the transfer destination setting processing described above.

Next, a description will be made for the case where it is judged in Step 902 that the transmitted information is lamp turning-on information. The lamp turning-on information is set to the transmitted information in Step 906, and then the final destination is set in Step 907. The final destination is the car terminal 20 or a floor terminal on a specified floor at which the lamp is to be turned on. After that, the transfer destination is determined in Step 905, and the radio wave is transmitted. If it is judged that the information is other than the above-mentioned kinds of information, it is judged that the transmitted radio wave is information to the mobile terminal 50 described above and the processing proceeds to Step 908. In Step 908, the information is set to the transmitted data (the priority: low level) and the final destination is set in Step 909. Since the communication to the mobile terminal 50 is a transmitted the radio wave to a floor or the car where the mobile terminal 50 is located, the final destination is set based on the set position code (the place where the mobile terminal 50 exists is specified). Then, in Step 905, the transfer destination is determined and the radio wave is transmitted.

The case of the signal receive interruption signal (IRQ2) will be described next. In Steps 910 and 911, the destinations (the final destination, the transfer destination) of the received radio wave are checked. In the present embodiment, the transfer processing in the relay transmission is not performed in the main terminal 40. Therefore, if the destination does not agree with the main terminal, the processing is directly completed. If the transfer destination and the final destination agree with the main terminal, the processing proceeds to Step 912 to analyze the contents of the transferred information and execute the corresponding processing. For example, if the received information is car call (destination) button information or information on hall call button, the data is transferred to the control unit 32 in Step 913. If it is judged in Step 912 that the information is information from an external unit, the identification code included in the information is checked in Step 914. Since the mobile terminal 50 and the control unit 32 have the same identification code in advance, the information is transferred to the control unit 32 only when the identification codes agree with each other. If the identification codes do not agree with each other, it is judged that the information is a radio wave from a unit other than the present elevator system, and the processing is completed.

In the above description, the terminals mounted on the car and the counterweight do not have the transfer function to the other terminals, that is, the relay station function. However, if the terminals mounted on the car and the counterweight are used as relay stations during movement, this can be performed by completely the same processing as that described in the other floor terminals under judgment of the existing position of the car and the counterweight at present.

Figure 10:
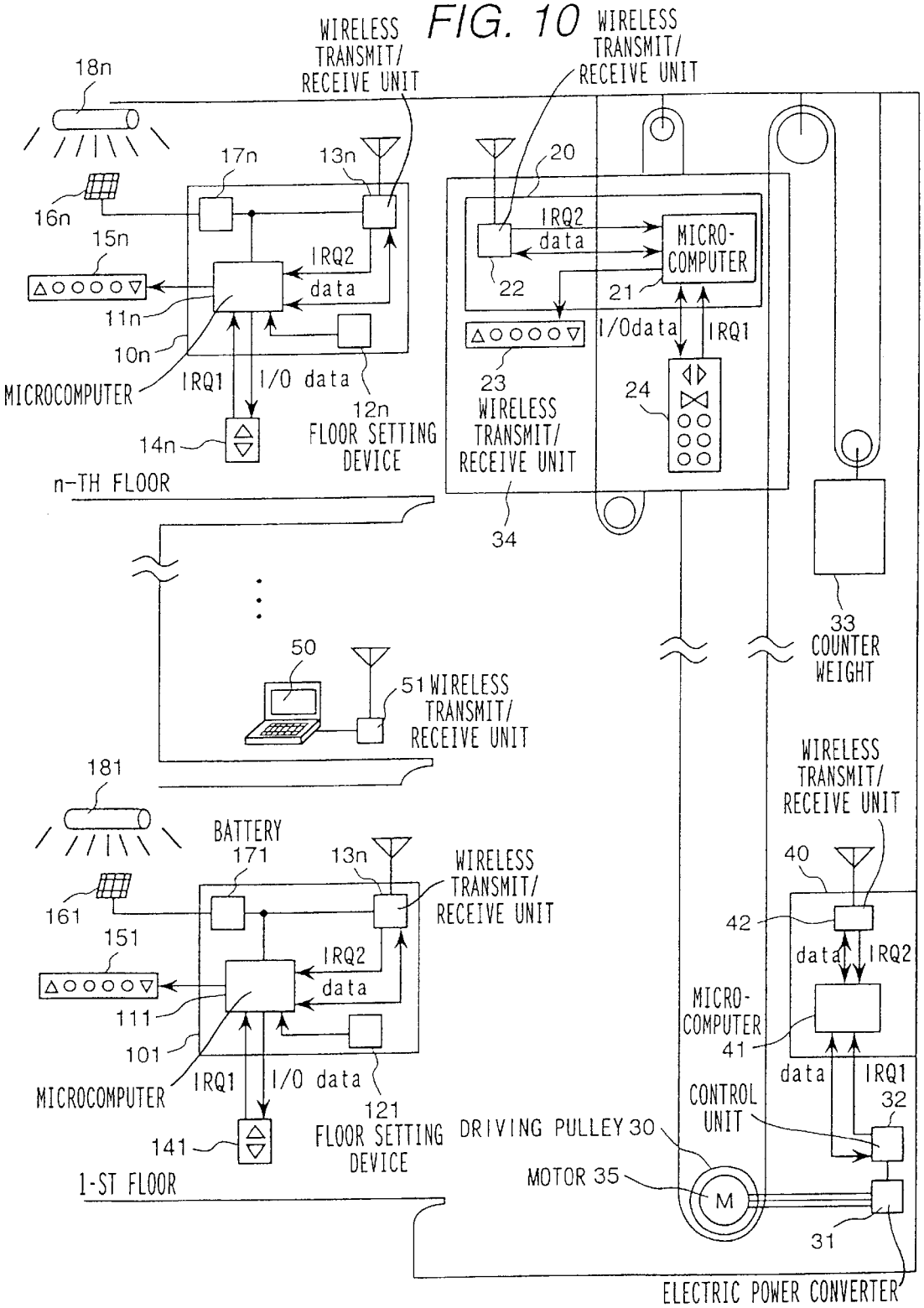
FIG. 10 is a block diagram showing the construction of another embodiment of an elevator system in which a control unit is placed in the hoistway.

FIG. 10 shows another embodiment of an elevator system in which the drive pulley 30 and the motor 35 for rotating the drive pulley are installed in a pit of the hoistway. An electric power converter 31 for supplying electric power to the motor 35 and a control unit 32 for control of the electric power converter 31 and control of the elevator are also installed in the well of the hoistway near the pit. Therein, the main terminal 40 is placed in the wall of the hoistway integrated with or separately from the control unit 32. The main terminal 40 comprises the microcomputer 41 and the wireless transmitting/receiving unit 42, and performs control and processing in completely the same manner as for the above-mentioned embodiment. The counterweight 33 may mount the relay station terminal. In an elevator in which the drive pulley 30, the motor 35, the electric power converter 31 and the control unit 32 are arranged in a machine room outside the hoistway on the rooftop of the building, the main terminal 40 may be placed in the machine room or the ceiling portion of the hoistway if the main terminal 40 has an antenna directed toward the inside of the hoistway.

The floor terminals are not limited to being installed on individual floors, but one terminal may be installed for 2 to 3 floors to cover transmitting and receiving of information for the several floors. Further, communication between the floor terminals and the main terminal may be performed using a LAN. One or more relay-only transmitting/receiving units may be arranged in the hoistway between the elevator control unit fixed or movable and the car.

Figure 11:
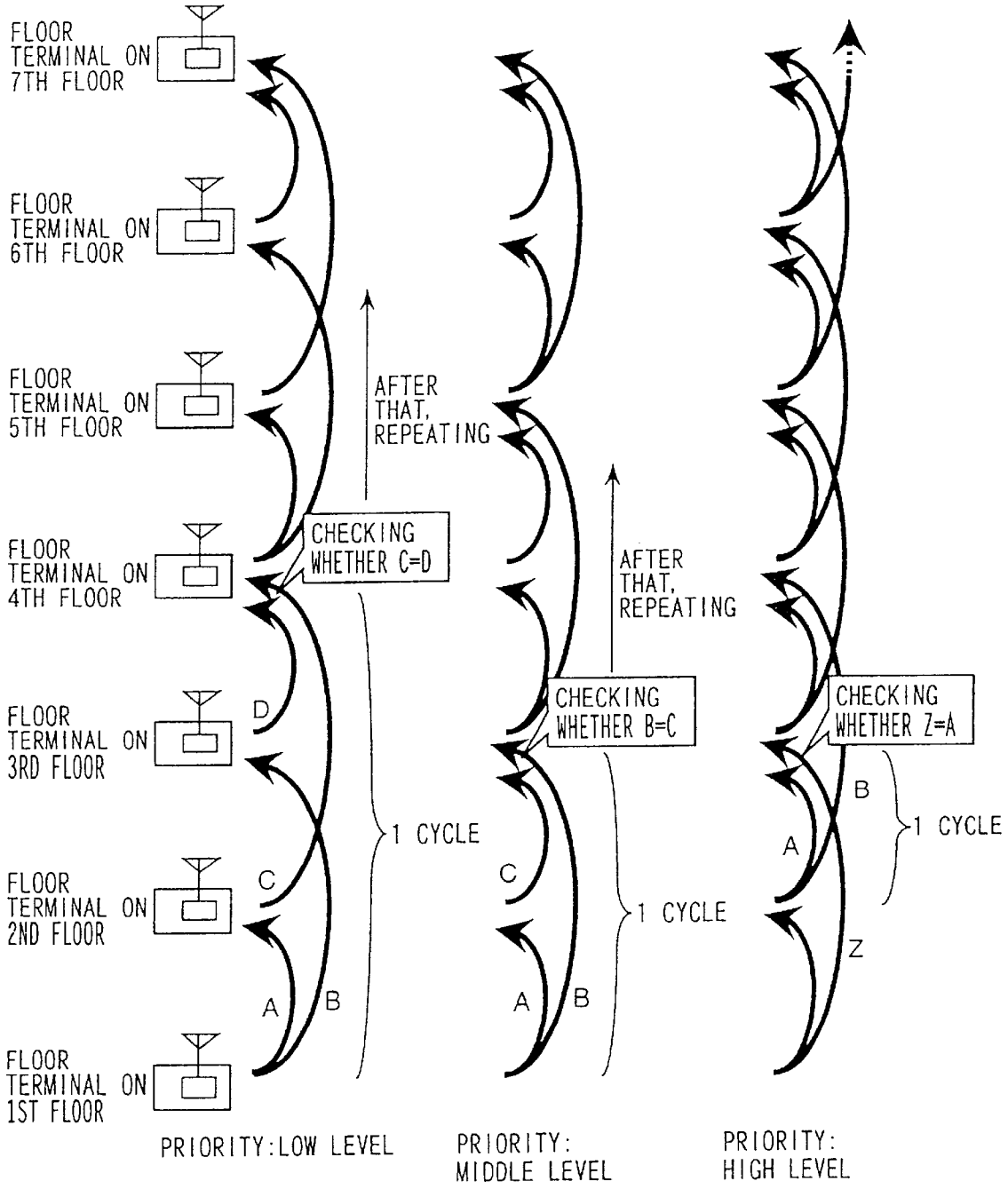
FIG. 11 is a diagram showing information transmission paths for various priorities.

FIG. 11 shows another embodiment in which transmission path is changed depending on the priority. In this embodiment, the priority is classified into three levels (low/middle/high). Firstly, the case of a transmission path having a low level priority will be described. The terminal on the first floor initially sends radio waves A, B having the same information to the floor terminals on the second floor and the third floor which are capable of receiving the radio waves. The terminal on the second floor sends the received radio wave A as radio wave C having the same information to the terminal on the fourth floor, skipping one floor. On the other hand, the terminal on the third floor, receiving the radio wave B, sends the radio wave D having the same information to the terminal on the fourth floor. Therein, in the terminal on the fourth floor, which receives the radio waves C and D through two different paths, the received data contents of the radio waves C and D are compared to check whether or not there is any error. The above processing is set as one cycle, and after that, the information is transmitted by repeating the cycle.

In the case of a transmission path having a middle level priority, the terminal on the first floor initially sends radio waves A, B to the floor terminals on the second floor and the third floor. Then, the terminal on the second floor sends the received radio wave A as the radio wave C having the same information to the terminal on the third floor. Therein, in the terminal on the third floor, which receives the radio waves B and C transmitted through two different paths, the received data contents are compared to check whether or not there is any error. The above processing is set as one cycle, and after that, the information is transmitted by repeating the cycle. Similarly, in the case of a transmission path having a high level priority, the received data contents are compared with the cycle as shown in the FIG. The difference among the three transmission paths is in the frequency of checking the received data contents. By performing the switching of the transmission path depending on the priority, the reliability of the information transmission can be improved.

According to the present invention, it is possible is to provide an elevator system in which information, such as an elevator call button signal, can be transmitted between the elevator control unit and the car or each of the floors using wireless transmitting/receiving units having a comparatively narrow communicable range, and which can reduce the number of elevator information transmission cables and simplify the installation of the elevator system.

what is claimed is:

1. An elevator system in which a car travels upward and downward among a plurality of floors, which comprises:

an elevator control unit; and terminals each having a wireless transmitting/receiving unit, said terminals being provided for an elevator control unit and for each of said floors, wherein transmitting/receiving of signals between two of said terminals distant from each other so as to at least enable wireless bidirectional communication between said terminals of said elevator control unit and one of said terminals of a respective floor being performed by relaying signals through a wireless transmitting/receiving unit of another of said terminals.

2. An elevator system in which a car travels upward and downward among a plurality of floors, which comprises:

terminals each having a wireless transmitting/receiving unit, said terminals being provided for each of said floors and for said car and/or for a counterweight, wherein transmitting/receiving of signals between two of said terminals distant from each other so as to enable wireless bidirectional communication among said terminals of said floors and said terminal of said car and/or said terminal of said counterweight being performed by relaying signals through a wireless transmitting/receiving unit of another of said terminals.

3. An elevator system in which a car travels upward and downward among a plurality of floors, which comprises:

terminals each having a wireless transmitting/receiving unit, said terminals being provided for said car and for a counterweight and for each of said floors, wherein transmitting/receiving of signals between said terminals of said car and said counterweight is performed by relaying signals through a wireless transmitting/receiving unit of a terminal on a floor so as to enable wireless bidirectional communication therebewteen.

4. An elevator system in which a car travels upward and downward among a plurality of floors, which comprises:

terminals each having a wireless transmitting/receiving unit, said terminals being individually provided for said car and for a counterweight and for a hoistway, wherein transmitting/receiving of signals between two of said terminals so as to enable wireless bidirectional communication among terminals of said car, counterweight and hoistway being performed by relaying the signals through a wireless transmitting/receiving unit of another of said terminals.

5. An elevator system in which a car travels upward and downward among a plurality of floors, which comprises:

terminals each having a wireless transmitting/receiving unit, said terminals being provided one for each group of one to several floors, one for said car and one for an elevator control unit in a hoistway, wherein transmitting/sending of signals between said terminals is performed by relaying the signals through other terminals so as to enable wireless bidirectional communication among said terminals of a respective group, said terminal of said car and said terminal of said elevator control unit.

6. An elevator system in which a car travels upward and downward among a plurality of floors, which comprises:

terminals each having a wireless transmitting/receiving unit, said terminals being provided one for each group of one to several floors, one for said car and/or one for a counterweight; and a mobile terminal which is capable of wirelessly transmitting/receiving signals to/from said terminal within an appropriate distance;

wherein wireless bidirectional communication is enabled among said mobile terminal, said terminals of a respective group, said terminal of said car and/or said terminal of said counterweight by relaying signals through at least another of said terminals.

7. An elevator system comprising a hall call button arranged at each floor; a car call button arranged in a car; and a control unit for controlling movement of the elevator car among a plurality of floors corresponding to operation of the call buttons, which comprises:

wireless transmitting units each for transmitting a signal of said hall call button from a landing entrance side into an elevator hoistway;

a wireless transmitting unit for transmitting a signal of said car call button from the car into said hoistway; and a wireless receiving unit for receiving the signal from each of said transmitting units and transmitting the signal to said control unit by relaying the signal through another transmitting/receiving unit, said wireless receiving unit being arranged inside said hoistway so as to enable wireless bidirectional communication among said wireless transmitting/receiving units and said control unit.

8. An elevator system comprising a hall call button arranged at each floor; a car call button arranged in a car; and a control unit for controlling movement of the elevator car among a plurality of floors corresponding to operation of the call buttons, which comprises:

a wireless transmitting unit for transmitting a signal of said car call button from the car into said hoistway;

a wireless transmitting/receiving unit for relaying and re-transmitting the car call signal from said transmitting unit, said wireless transmitting/receiving unit being arranged inside said hoistway; and a wireless receiving unit for receiving the car call signal from said wireless transmitting unit of the car or from said wireless transmitting/receiving unit in said hoistway and for transmitting the car call signal to said control unit, said wireless receiving unit being arranged inside said hoistway so as to enable wireless bidirectional communication among said wireless transmitting/receiving units and said control unit.

9. The elevator system according to any one of claims 1 and 2, wherein transmitting/receiving of a signal is performed between two terminals distant from each other by being relayed through the wireless transmitting/receiving unit of a terminal on an adjacent floor.

10. The elevator system according to any one of claims 1 and 2, wherein transmitting/receiving of a signal is performed between two terminals distant from each other by being relayed through the wireless transmitting/receiving unit of a terminal on a next adjacent floor.

11. The elevator system according to any one of claims 1 and 2, wherein transmitting/receiving of a first signal is performed between two terminals distant from each other by being relayed through the wireless transmitting/receiving unit of a terminal on an adjacent floor, and transmitting/receiving of a second signal is performed between two terminals distant from each other by being relayed through the wireless transmitting/receiving unit of a terminal on a next adjacent floor.

12. The elevator system according to the claim 11, wherein the terminal comprises a means for comparing the information received from the wireless transmitting/receiving unit of the terminal on the adjacent floor with the information received from the wireless transmitting/receiving unit of the terminal on a floor by skipping one floor.

13. The elevator system according to any one of claims 1 to 4, 5 and 6, wherein the terminal comprises a solar battery panel and a battery.

14. The elevator system according to claim 4, wherein the counterweight mounts the control unit to which the hall call button signal and the car call button signal are input.

15. The elevator system according to any one of claims 1 to 4, 5 to 7 and 8, wherein the wireless transmitting/receiving unit has a transmission capacity of a communicable distance within a range longer than 2.5 m and shorter than 10 m.

16. The elevator system according to any one of claims 1 to 4, 5 to 7 and 8, wherein the wireless transmitting/receiving unit transmits a radio wave: in a frequency band which is less than 322 MHz and which has an electric field intensity at a 3 m distant position of less than 500 $\mu$V/m; in a frequency band which is within the range of 322 MHz to 10 GHz and which has an electric field intensity at a 3 m distant position of less than 35 $\mu$V/m; in a frequency band which is within the range of 10 GHz to 150 GHz and which has less than 3.5 (f$\mu$V/m) within a range of an electric field intensity at a 3 m distant position not exceeding 500 $\mu$V/m; or in a frequency band which is within the range above 150 GHz and an electric field intensity at a 3 m distant position which is less than 500 $\mu$V/m.

* * * * *